US006015129A

United States Patent [19]

Harrigan

[11] Patent Number: 6,015,129

[45] Date of Patent: Jan. 18, 2000

[54] UNIVERSAL READING AND WRITING SURFACE SUPPORT

[76] Inventor: Christopher L. Harrigan, 3575 W. Dickens, Chicago, Ill. 60647

[21] Appl. No.: 09/112,876

[22] Filed: Jul. 9, 1998

[51] Int. Cl.[7] ..... A47B 97/04

[52] U.S. Cl. ..... 248/444; 248/451; 248/455; 248/460; 248/463

[58] Field of Search ..... 248/448, 441.1, 248/444, 447, 449, 451, 454, 457, 458, 460, 462, 463; 224/185, 614, 661, 663, 665

[56] References Cited

U.S. PATENT DOCUMENTS

| | | | |
|---|---|---|---|
| 760,299 | 5/1904 | Belding | 248/451 |
| 869,918 | 11/1907 | Lipscond . | |
| 1,035,290 | 8/1912 | Wood . | |
| 1,232,089 | 7/1917 | Riebe . | |
| 1,938,528 | 12/1933 | Marseglia . | |
| 2,244,773 | 6/1941 | Hawk | 248/451 |
| 2,481,107 | 9/1949 | Gore . | |
| 2,599,416 | 6/1952 | Saecker | 248/447 |
| 2,741,869 | 4/1956 | Aibel . | |
| 3,065,565 | 11/1962 | Goodman | 248/460 |
| 3,076,285 | 2/1963 | Sparkman | 248/448 |
| 3,408,032 | 10/1968 | Francis | 248/451 |
| 3,664,629 | 5/1972 | Reed . | |
| 3,952,989 | 4/1976 | Hatcher | 248/460 |
| 4,116,413 | 9/1978 | Anderson . | |
| 4,150,464 | 4/1979 | Tracy . | |
| 4,171,555 | 10/1979 | Bakker et al. . | |
| 4,467,991 | 8/1984 | Bailes | 248/448 |
| 4,470,571 | 9/1984 | Hartman . | |
| 4,718,630 | 1/1988 | Richard . | |
| 4,856,749 | 8/1989 | Habermann | 248/448 |
| 5,054,736 | 10/1991 | Champoux . | |
| 5,129,616 | 7/1992 | Carson . | |
| 5,485,980 | 1/1996 | Luccia . | |
| 5,660,117 | 8/1997 | Noble | 248/460 |
| 5,667,182 | 9/1997 | Kribs | 248/448 |
| 5,797,578 | 8/1998 | Graffeo et al. | 248/460 |

*Primary Examiner*—Derek J. Berger
*Assistant Examiner*—Debbie Short
*Attorney, Agent, or Firm*—Juettner Pyle & Piontek

[57] ABSTRACT

An adjustable, portable platform for supporting and holding written materials or the like in a selectable position convenient to the user is disclosed. The platform comprises a central member and a pair of laterally movable frame members disposed on each side of the central member. A pair of panels are pivotally attached at a proximal end thereof to the platform proximate the central member substantially between the upper and lower transverse sections, with retaining means thereon for securely retaining the written materials or the like in a secure position on the panels. Attachment means on the pivotable panels allow the pivotable panels to be adjustably attached to the frame members to accept and adapt to the written materials. The pivotable panels also allow for adjustment of the lateral width of the platform and are attached via dowels near the longitudinal section of the central member, with each pivotable panel having a base portion and a slidable portion attached thereto, the slidable portion having the attachment means provided thereon. A shelf rest is joined to the bottom of the central member projecting transversely to support the bottom edge of a book or other materials to be held in the platform. Various supports and straps can be adjusted to orient and support the platform in a wide number of positions relative the user.

25 Claims, 7 Drawing Sheets

UNIVERSAL READING AND WRITING SURFACE SUPPORT

FIELD OF THE INVENTION

The present disclosure relates to a portable personal surface support. More particularly, the present disclosure teaches a portable, lightweight and adjustable platform upon which a user may conveniently rest, in a restrained manner, reading and writing materials and the like while keeping the user's hands free for other tasks.

BACKGROUND OF THE INVENTION

The utility of portable platforms for reading and writing materials as used in the home and in business environments is well known. Supporting such materials in a convenient and ready position for viewing reduces fatigue and frees the user's hands for other tasks, such as writing or typing. Supporting such materials further allows the physically impaired to readily enjoy reading.

Reading/writing material supports appear in the prior art. Examples of such stands or supports include book rests designed for use on tables and desks, sheet music holders (also called music stands) supported on fixed or movable uprights, book holders designed to set in the user's lap (also called lap desks), and book holders that hold reading material above the user's head while in the supine position, typically used by handicapped or incapacitated persons. The advantages of such devices are well known, yet many of the existing devices fall far short of an ideal arrangement.

For example, supports of the prior art are in many instances heavy, cumbersome and suited only for use in certain circumstances or with certain types of reading material. A support designed for a small paperback book, for example, may not accommodate a large magazine or a newspaper. Similarly, book holders of the prior art designed to rest on top of a desk or table are not capable of holding reading material above a person's head while in a supine position. Thus, very few of these prior art supports have met with commercial success.

The vast majority of prior art book holders also suffer from the fact that a fixed planar surface upon which the book is secured is used. Securing a book to a planar surface, however, forces the book into a 180° full-open position. Particularly with hard-cover books and perfect-bound magazines, a full-open position tends to damage the book spine or tear the adhesive elements, possibly to the point where the book may lose its pages or otherwise deteriorate.

Examples of such prior art book holders requiring a book to be in the full-open position include the book holder taught in U.S. Pat. No. 5,129,616 to Carson, which discloses a tiltable planar book tray with adjustable leg brackets for leg pairs. Similarly, U.S. Pat. No. 5,054,736 to Champoux discloses a book holder having a flat worktable panel that allows adjustment of its inclination relative a base panel. U.S. Pat. No. 4,718,630 to Richard discloses a reading holder having a planar sheet member with a plurality of hollow leg tubes. U.S. Pat. No. 2,244,773 to Hawk teaches a planar table for multiple uses. U.S. Pat. No. 3,664,629 to Reed discloses an adjustable stand having a tiltable shallow tray with a flat, planar bottom to receive the outspread covers of a book which is supported between two pairs of spreading legs.

In addition to the disadvantages associated with book holders requiring the book to be opened to the full-open position, the prior art fails to provide self-supporting book holders designed for use while standing or sitting. For example, although U.S. Pat. No. 5,485,980 teaches an inverted book stand having a peaked configuration, it is limited to use in the supine position only. U.S. Pat. No. 2,481,107 to Gore discloses a combined rest, magazine support and book holder having a table and holder element without means for securing it to the user's body while standing or sitting. Gore recites that the lower edge of the holder may be supported by one hand or by a belt hook or vest button clip if the user's anatomy does not provide a secure support. U.S. Pat. No. 1,232,089 to Riebe discloses a book support having a table with rearwardly extending arms to which a flexible band is attached to bear against the user's body. Riebe, however, teaches no means for securing the flexible band, and the entire apparatus, to the user's torso in the preferred embodiment.

Accordingly, to provide a solution to these problems, it is desirable that there be one portable device that can conveniently be: a) adapted to support a wide variety of printed or viewable materials of varying sizes and shapes without the use of the user's hands; b) applied to a myriad of environments, such as on a table top, bed or couch or attached to its user's body; and c) used while its user is in a wide number of postures, such as sitting, laying down, standing, running, exercising or stooping. Further, it is desirable to have such a device adaptable to accepting a writing surface for use in many of the same environments and postures, such as sitting on a couch or laying down in bed.

In sum, a portable, lightweight, adjustable and collapsible device for releasably restraining any of a book, magazine, newspaper or other such reading or viewable materials to free the user's hands while reading, viewing or writing was needed.

SUMMARY OF THE INVENTION

To overcome these and other disadvantages of the prior art, the present disclosure, briefly described, provides, in general form, an adjustable, portable platform for supporting and holding written materials or the like in a selectable position convenient to the user. The platform comprises a central member having an upper transverse section and a lower transverse section joined at their centers by a longitudinal section. A pair of laterally movable frame members are provided, with one frame member disposed on each side of the central member engaging both the upper and lower transverse sections of the central member. A pair of panels are pivotally attached at a proximal end thereof to the platform proximate the central member substantially between the upper and lower transverse sections. Each of the panels is provided with retaining means thereon for securely retaining the written materials or the like in a secure position on the panels. Attachment means are located on a distal end of each of the pivotable panels for attachment of the pivotable panels to one of the frame members such that the relative angle formed between the pivotable panels can be adjusted to accept and adapt to the written materials.

Construction of all components of the platform is of a rugged, lightweight material. The central member is preferably "V-shaped" or of syncline configuration to provide an improved framework for supporting bound materials. Through the extending frame members, the user can conveniently adjust the lateral size of the platform to accommodate reading materials having a variety of widths.

The two pivotable panels also allow for adjustment of the lateral width of the platform and are attached via dowels near the longitudinal section of the central member. Each of the pivotable panels has a parallel base portion and a parallel slidable portion attached thereto, the slidable portion having the attachment means provided thereon. Preferably, the attachment means comprises a flange mounted on the slidable portion perpendicular relative to the pivotable panel for selectively affixing the pivotable panels to the extending frame members, which are preferably of a "U-shaped" configuration. Adjustment of the flange relative to the extending frame members allows the user to conveniently vary the pivotable panel inclination angle relative to the central member and frame members to preserve a book's spine and to assist the reader in convenient reading.

A spring clip for holding the pages of the book is mounted to the slidable portion of the pivotable panel near an outside edge thereof. The spring clips are biased toward the pivotable panel to stabilize the open pages of printed or viewed materials placed thereunder, yet are released with a minimum of effort. The adjustability of the slidable portion of the pivotable panel provides its user with the convenience of having a primary means for setting the lateral position of the holder spring clips relative the reading materials to be secured, thereby accommodating a variety of widths.

A shelf rest is located at the bottom of the central frame member and projects transversely to span the width of the platform when the extending frame members are fully extended, The shelf rest supports the bottom edge of a book or other materials to be held on the platform.

To support the platform, a multi-positional shoulder is rotatably disposed within a vertical sleeve projecting through the top of each extending frame member near its outside edge and is preferably adjustable and lockable via interlocking splines by screw means. A telescoping arm is rotatably coupled with a splined post projecting outwardly near the top of each shoulder.

A retractable, multi-positional leg extends downward from the interior of the preferably hollow longitudinal portion of each extending frame member and preferably comprises three segments with pivotable attachments therebetween. The retractable, multi-positional legs are jointed to allow adjustable placement of the legs to support the platform in a wide array of positions. A base is joined to the bottom of the each leg and generally has a concave shape with planar ends to advantageously maximize friction upon a wide variety of surfaces. This serves to stabilize the entire platform.

An arm connector strap is adjustable to span the distance between the arms and its ends and is removably fastened to the base thereof. The arm connector strap is used in certain modes of operation to advantageously provide stability for the upper portion of the platform. As described more fully in the detailed description of the preferred embodiment, it is preferred that the center of the arm connector strap be placed behind the user's head and against the back side of the neck when the user is in a seated posture. Since it is preferred that the vertical plane of the platform be inclined slightly away from the user, the top portion of the platform will bias the arm connector strap against the back side of the user's neck, thus supporting itself without the user's hands holding the platform.

As will appear from the detailed description of the preferred embodiment to follow, the features of the platform render it suitable for a wide variety of conditions and uses. In addition to the advantages of the platform being adjustable to accommodate materials having a multitude of sizes, shapes, and thicknesses, the platform can be used in a multitude of environments, such as being: a) placed on top of a desk or table; b) set upon the legs of the user seated or in semi-seated postures; c) secured to the user's torso, allowing the user to stand, move about or even exercise; and d) placed upon a bed to permit the user to lay in a supine position to look up at a book positioned overhead.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto, In this respect, before explaining the several preferred embodiments of the disclosure in detail, it is to be understood that the disclosure is not limited in its application to the details of the construction and the arrangements of the components set forth in the following description or illustrated in the drawings. The platform of the present disclosure is capable of other embodiments and of being practiced and carried out in various ways. Also, it is to be understood that the phraseology and terminology employed herein are for description and not limitation. Where specific dimensional and material specifications have been included or omitted from the specification or the claims, or both, it is to be understood that the same are not to be incorporated into the appended claims.

As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention.

Further, the purpose of the Abstract is to enable the U.S. Patent and Trademark Office and the public generally, and especially the scientists, engineers and practitioners in the art who are not familiar with the patent or legal terms of phraseology, to learn quickly from a cursory inspection the nature and essence of the technical disclosure of the application. Accordingly, the Abstract is intended to define neither the invention nor the application, which is only measured by the claims, nor is it intended to be limiting as to the scope of the invention in any way.

Therefore, it is the primary object to provide a new and improved portable platform for supporting and holding written materials or the like that is truly universal in that it allows the user to read or view material substantially hands-free in numerous postures, including, but not limited to, sitting, supine, standing, walking about, exercising, stooping, squatting or bending.

A further object is to provide a portable platform for supporting and holding written materials or the like that is adjustable to accommodate a wide range of sizes, widths and thicknesses in reading material or the like, including, but not limited to, small paperback books, large hard-bound books, newspapers, magazines, maps, loose-leaf paper, photographs and brochures, all without any mechanism or obstruction interfering with the material being read or viewed.

Another object is to provide an adjustable, portable platform for supporting and holding written materials or the like utilizing a new and novel frame design that allows adjustment of the inclination angle of the panels upon which the book rests, serving to protect the spines of the books, or other bound materials, secured therein.

An additional object is to provide a portable platform for supporting and holding written materials or the like having an adjustable means for determining the vertical location of the material secured thereon so that the center of the surface of that material is substantially perpendicular to the reader's line of sight, relieving the neck strain associated with viewing materials below the reader's line of sight, and permitting the reader to better focus on the material.

A still further object is to provide an adjustable, portable platform for supporting and holding written materials or the like that is relatively simple to use and easily collapsed for storage and for ready transport.

Yet another object is to provide an adjustable, portable platform for supporting and holding written materials or the like combining a light-weight design with sufficient rigidity to ensure complete steadiness in the supported materials.

A further object is to provide an adjustable, portable platform for supporting and holding written materials or the like that has a relatively low cost of manufacture with regard to both materials and labor, thereby making the platform more available to the buying public.

An additional object is to provide an adjustable, portable platform for supporting and holding written materials or the like capable of easily assuming numerous modified use orientations for different modes of operations as desired by its user.

These and other objects, along with the various features and structures that characterize the invention, are pointed out with particularity in the claims annexed to and forming a part of this disclosure. For a better understanding of the platform of the present disclosure, its operating advantages and the specific objects attained by its uses, reference should be had to the accompanying drawings and descriptive matter in which there are illustrated preferred embodiments of the invention.

BRIEF DESCRIPTION OF THE DRAWINGS

The disclosure of the adjustable, portable platform for supporting and holding written materials or like is explained with illustrative embodiments shown in the accompanying drawing, where.

DETAILED DESCRIPTION OF THE PREFERRED EMBODIMENT

Figure 1:
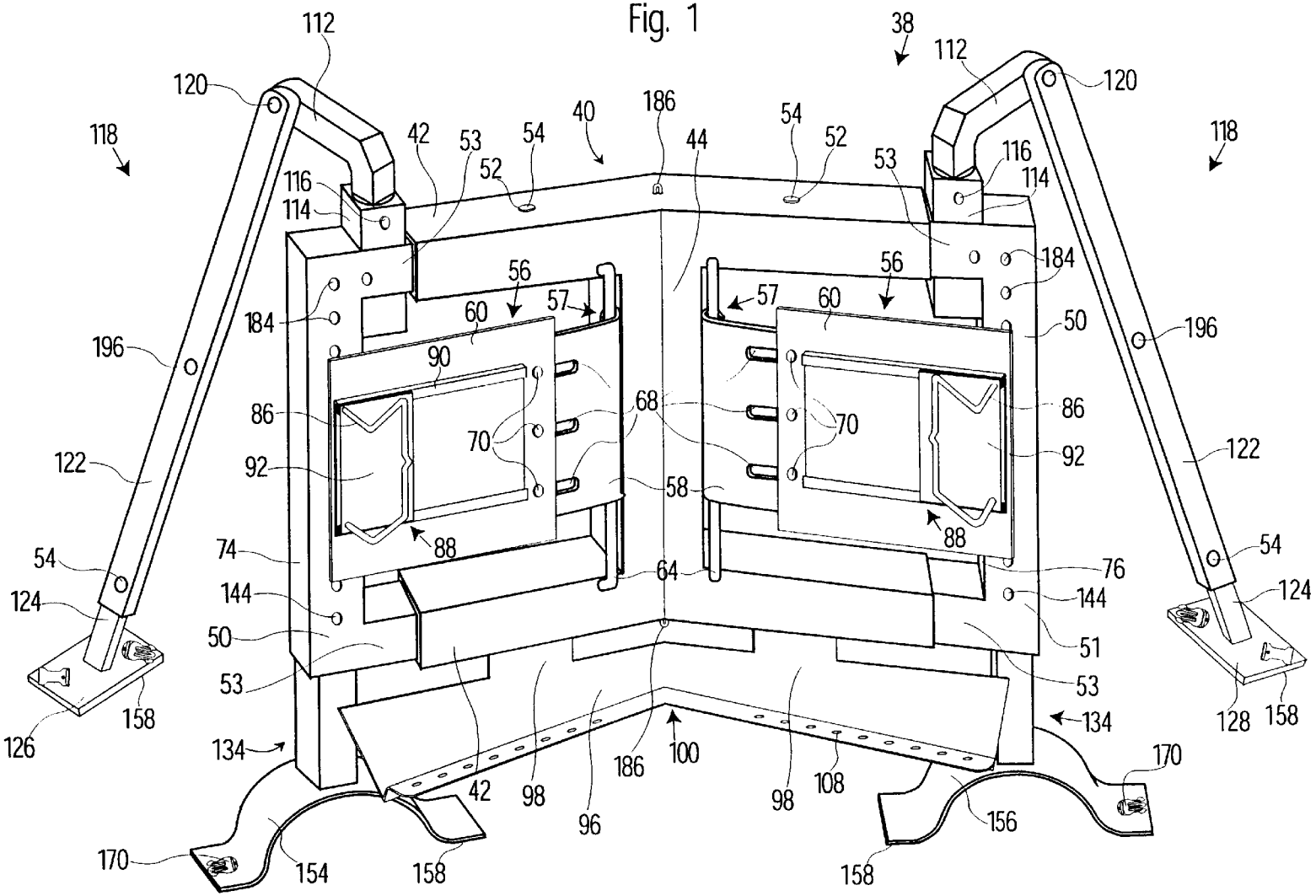
FIG. 1 is a perspective view of a first embodiment of the adjustable, portable platform of the present disclosure.

Referring now to the drawings, particularly FIG. 1, there is shown a first embodiment of the disclosed adjustable, portable platform 38 for supporting and holding written materials or like as illustrative or exemplary of the invention. The best mode for carrying out the invention is presented in terms of a preferred embodiment, wherein similar reference characters designate corresponding parts throughout the several figures of the drawings. As used herein, the term "book," whether singular or plural, is intended to refer to, and to be used interchangeably with, printed or viewable materials in any form, including, but not limited to, books, magazines, newspapers, brochures, maps, photos and illustrations.

The present disclosure teaches an adjustable, portable platform 38 for supporting and holding written materials or the like having, as its primary component, a central member 40. The central member 40 preferably is formed of three sections, including two transverse sections 42 and one longitudinal section 44. Each section of the central member 40 is preferably hollow, having a square or rectangular cross-sectional shape. The central section 40 also is preferably made of a rigid and durable material, having a cross-sectional thickness optimizing compactness, strength and durability. The longitudinal section 44 of the central member 40 is of a sufficient length so as to accommodate printed or viewed materials having a large height or length. The two transverse sections 42 have equal lengths and are preferably formed at right angles at each end of the longitudinal section 44, preferably giving the central member 40 an "I-shape."

Figure 3:
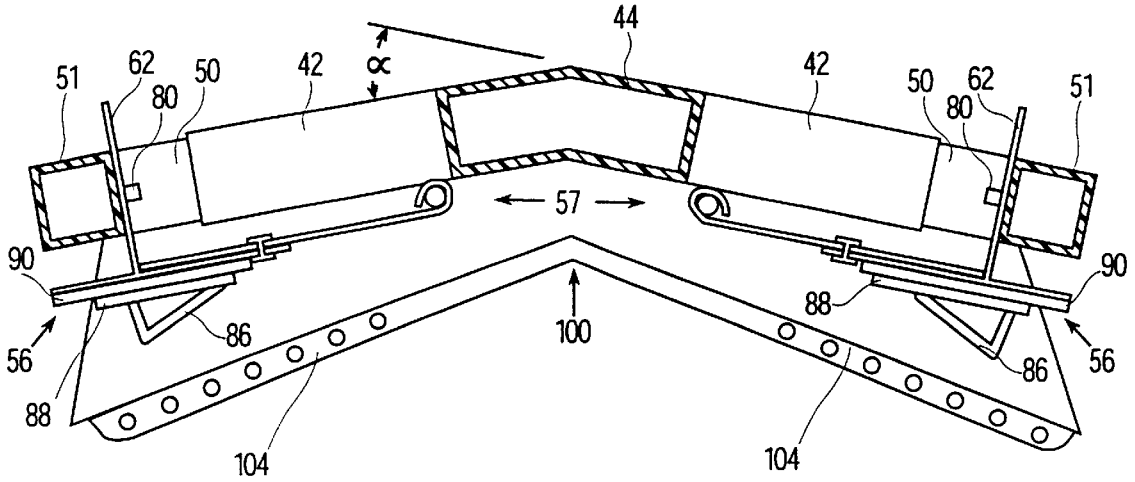
FIG. 3 is an cross-sectional view of the first embodiment of FIG. 1 of the adjustable, portable platform of the present disclosure, taken along the line 3—3 in FIG. 2.

As best seen in FIG. 3, the longitudinal section 44 of the central member 40 preferably has a "V-shaped" or synclined configuration, such that the each respective end of the two transverse sections 42 are not co-planar and are not in alignment with a single vertical plane. As a result, the longitudinal section 44 imparts a syncline or "V-shape" configuration to the transverse sections 42, as also seen in FIG. 3. The resulting synclination preferably forms an angle a approximately between 15° to 20°.

The synclination angle $\alpha$ of the central member 40 solves many of the disadvantages associated with planar prior art supports. While planar platforms force bound books into an undesired full-open position, the structural design of the central member 40, with its built in synclination angle $\alpha$, provides a superior method for supporting bound materials. Thus, the central member 40 preserves the binding of books and lengthens the useful life of bound materials. Additionally, the synclined shape of the central member 40 provides lateral support for bound materials placed therein, as the spine of those materials conveniently centers itself into the recess or valley of the "V-shaped" transverse sections 42 and longitudinal section 44.

A pair of extending frame members 50 are slidably mounted to the hollow transverse sections 42 of the central member 40 so as to allow lateral displacement and thereby obtain width adjustment of the platform 38. The extending frame members 50 each preferably have a "U-shape" configuration, with a longitudinal portion 51 of the extending frame members 50 having approximately the same length as that of the longitudinal section 44 of the central member 40. The two transverse portions 53 of each extending member 50 are formed at right angles to the longitudinal portion 51 and have an equal length of between approximately 60% to 85% that of the length of transverse section 42 of the central member 40.

The extending frame members 50, like the transverse sections 42, preferably have a square or rectangular cross-sectional shape with an external cross-sectional dimension slightly less than the internal cross-sectional dimension of the transverse sections 42 of the central member 40 into which they are slidably disposed. The extending frame members 50 are independently adjustable and conveniently provide one of the two means available by which the user may adjust the width of the platform 38 to accommodate reading materials having different widths. For example, the extending frame members 50 can be pushed inward to their maximum retracted position to restrain a book having a narrow width, such as a small paper-back book. Alternatively, the extending frame members 50 can be pulled out to their fully extended positions to restrain a book having a large width, such as a newspaper. Intermediate positions are provided for reading materials of varying widths.

Integral motion limiting means are preferably provided on each frame member 50 to limit their outward motion and prevent them from being withdrawn from the central member 40. Such motion limiting means can take several forms. One such means includes a length or band of flexible material (not shown), such as nylon, with one end fastened to an interior surface of the frame member 50 and the other end being fastened to an interior surface of the transverse section 42 of the central member 40. The length of this material is calibrated to allow the frame members 50 to extend out only to its furthest extension position. As the frame member 50 is pulled outwardly, the motion limiting band extends within the interior of the central member 40 and transverse portion 53 of the frame members 50 for only a certain length and thus prevents the frame member 50 from being accidentally withdrawn from the central member 40. Alternatively, a motion limiting boss (not shown) can be provided on the interior of the transverse section 42 situated to interfere with further outward motion of a cooperating stop (not shown) located on the exterior of one or both of the transverse portions 53 of the frame member 50. Other techniques, such as pins, detents, notches and the like, can be used to limit the outward displacement of the frame members 50.

Locking means for securing the frame members 50 within the transverse sections 42 can take a variety of forms, including such well known mechanisms as openings and pins and dowels. However, it is preferred that spring loaded detents 54 be used in combination with openings 52 disposed along the upper one of the transverse portions 53 for releasably locking the extending frame members 50 in a fixed position. Such detents 54 are well known in the art and operate by urging an integral leaf spring and pin against mating holes (not shown) in both the outside and inside members. Thus, adjustment is obtained by depressing the hole protruding portion or pin actuator disposed inside the frame member 50 at detent 54 and then sliding the frame member in or out as desired until a new hole 52 is in alignment and the pin protrudes therethrough, locking the frame member 50 securely in place. A plurality of detent positions is provided in each extending member 50 for conveniently locking these members 50 into a variety of positions for restraining reading materials or books having a variety of widths.

Figure 2:
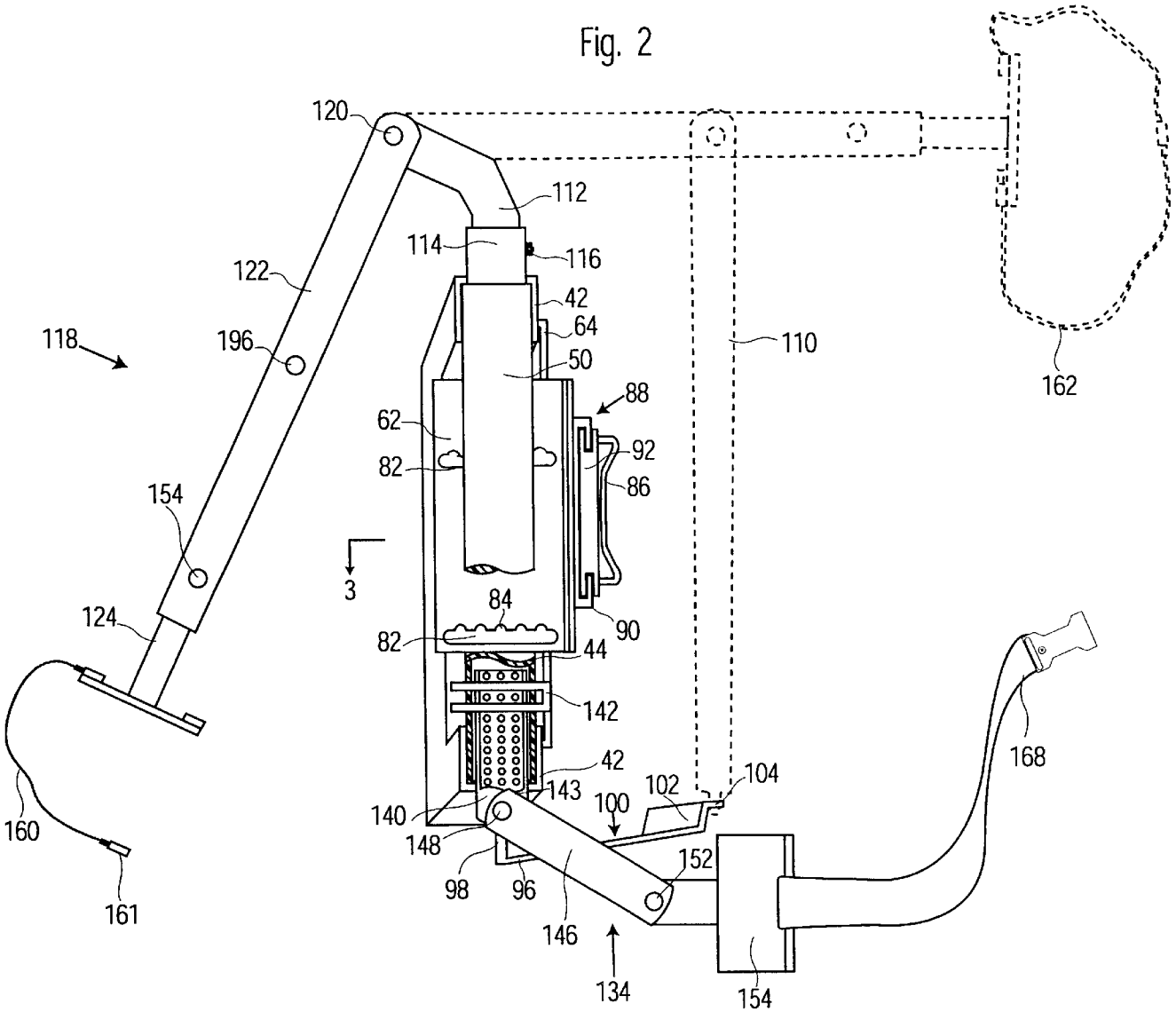
FIG. 2 is an elevation side view of the first embodiment of FIG. 1 of the adjustable, portable platform of the present disclosure and partial cross-sectional view of one of the frame members of the same.

A pair of pivoting panels 56 are adjustably attached to the central member 40 and frame members 50. These panels 56 provide the means to conveniently support and restrain books to the platform 38. Each pivoting panel 56, best seen in FIGS. 1, 2 and 3, is made of a rigid, durable material and preferably comprises three pieces: a base portion 58, a slidable portion 60, and an attachment means, shown here preferably as flange 62. Both pivoting panels 56 are substantially identical in structure and function except that they operate in opposite lateral directions and are inclined one to the another. The components of the pivotable panels 56 are interconnected to one another, and by means of a simple manipulation, may conveniently be collapsed from an inclined use position to a compact and flat stowage/transport position as further discussed below.

Alternately, the central member 40 can be co-planar, that is, each respective transverse end of the two transverse sections 42 are co-planar and are in alignment with a single vertical plane. As a result, the longitudinal section 44 does not form a syncline or form a "V-shape" configuration relative to the transverse sections 42. While a less desirable embodiment, the "V-shaped" orientation for an angle a between 15° to 20° is obtained via the pivotable panels 56 as discussed herein.

Each base portion 58 is planar and is connected by suitable pivot means 57 disposed near the longitudinal section 44 of the central member 40. The base portions 58 are preferably rectangular or square in shape, with a rigid and durable, yet lightweight, thickness. Further, it is desirable that the base portions 58 have a length between approximately 50% to 100% that of the length of the longitudinal section 44 of the central member 40, and a lateral dimension of slightly less than 50% of the length of a transverse section 42 of the central member 40. Although the Figures show the base portions 58 and slidable portion 60 having a height of approximately one-half that of the central member 40, the base portions 58 and slidable panels 60 can have different lengths, including lengths equal to that of the central member 44.

The pivot means 57 preferably includes pivot pins 64 of circular cross-section substantially extending the length of the central member 40 fastened to the proximal surfaces of the transverse sections 42 of the central member 40. There are numerous means available for attaching the base portions 58 to the pivot pins 64, however, it is desirable that the inner edge of the base portions 58 be molded to wrap approximately 270° around the pin 64 to form a hinge-type pivot. A minor clearance between the pin 64 and the inside surface of the molded portion of the pivot means 57 allows the pivotable panel 56 to pivot about the pins 64.

The base portions 58 are provided with a plurality of elongated slots 68 of equal length. The elongated slots 68 are disposed in a parallel, transverse manner and each have a length slightly less than that of the width of the base portion 58. The width of the slots 68 is preferably between 0.125 inch to 0.33 inch. The slidable portions 60 are planar and are slidably connected to the base portions 58 via rivets 70. The rivets 70 extend a predetermined length through and beyond the back surface of the slidable panels 60, the length being slightly greater than the thickness of the base portion 58. The rivets 70 thus project perpendicularly through the slidable portions 60 and the slots 68 in the base portions 58 to slidably connect the pieces of the pivotable panels 56. Each rivet 70 has a cross-sectional diameter slightly less than the width of the slots 68 to allow the rivets 70 to slide within and along the elongated slots 68. The slidable portions 60 are disposed above the base portions 58 with the rivets 70 of the slidable portion 60 extending through the slots 68 of the base portion 58. The rivets 70 terminate with enlarged heads or caps having a dimension larger than the width of the slots 68, preventing separation of the base portion 58 from the slidable portion 60. The length of the rivets 70 are such that a slight clearance exists between the bottom cap of the rivets 70 and the underside of the base portion 58 to allow the width-wise adjustment of the slidable portion 60 in relation to the stationary, but pivotable, base portion 58.

The slidable portion 60 as shown in the Figures has a length approximately the same as that of the base portion 58. The width of the slidable portions 60 is such that when the slidable portion 60 is coupled with the base portions 58 as described above, the pivotable panel extends flush to an outside surface 74 of the longitudinal portion of the frame members 50.

However, as an alternative embodiment, the slidable portion 60 may fan out to a length, at its extreme outwardly position, of an additional three-quarters of the length of the transverse section of the extending frame member 50. This extra platform surface area provides support for the outer edges of an open book secured thereon, particularly magazines, which because of their lack of sufficiently stiff book covers would fall. This extra surface area provides the further convenience of not having to support the ends of the pages of the book manually.

The slidable portions 60 of the pivotable panels 56 are adjustably fastened to an interior surface 76 of the frame members 50 via an attachment means, which preferably includes the flange 62 perpendicularly formed on the underside of the slidable portion 60. The flange 62 is located a short distance from the outer edge of the slidable portion 60, the distance being approximately equal to the lateral outside dimension of the longitudinal portion 51 of the frame members 50. Each flange 62 preferably has a longitudinal length equal to that of the slidable portion 60 it is formed upon, unless the slidable portion 60 length exceeds 60% of the longitudinal length of the frame member 50. In the latter case, the flange 62 length should not exceed 60% of the longitudinal length of the frame member 50 because the flange 62, if longer, would hit the bottom end of the shoulder sleeve 114, discussed below.

As shown in FIG. 3, the attachment means also includes a plurality of bosses 80 extending from the inside surface 76 of the longitudinal portion 51 of each frame member 50. Each flange 62 has a plurality of flange slots 82, best seen in FIG. 2, that slidably receive the bosses 80. The flanges 62 are thus movable along the bosses 80 and within the frame members 50. The bosses 80 have a cross-sectional diameter slightly less than the width of the flange slots 82 and terminate with enlarged heads having a dimension greater than the width of the slots 82 to prevent undesired separation of the flange 62 from the frame members 50. It should be understood that numerous means are available for releasably and adjustably locking the panels 56 to the frame member 50, such as tongue and groove, notched pin and hole, snaps, hook and loop fasteners, magnets and the like.

However, it is preferred that the attachment means be provided with a plurality of evenly spaced semi-circular notches 84 located on the upper edge of the slot 82 in the flanges 62. The weight of materials secured to the pivotable panels 56 biases the upper edges of the flange slots 82 against the bosses 80, whereupon the bosses 80 registers with one of the notches 84. The length of the flange slots 82 should allow placement of the pivotable panel 56 in numerous inclined positions relative the frame members 50. For example, if inclination of the panel 56 is needed or desired, the panels 56 may be flattened so that the slidable portion 60 contacts the longitudinal portion of the frame member 50. Incidentally, this flattened position of the panels 56 can be obtained to stow or transport the platform 38. Conversely, the user may raise the panel 56 to an inclined position as determined by the notches 84, up to a maximum inclined position determined by the length of the flange slots 82. Such adjustment of the angle $\alpha$, in relation to the existing synclination of the central member 40, allows the user to increase the inclination of the panel 56 onto which a book is secured to further preserve the book's spine and maximize the useful life of books secured thereto, as well as assist in convenient reading.

The frame members 50 are one of the two means that the lateral size of the platform 38 may be adjusted to accommodate materials having a variety of widths. The extending members 50 are easily and smoothly retracted, by pushing the extending members 50 inward which, in turn, collapses the panels 56 by pushing the slidable portion 60 along the elongated slots 68 of the base portion 58. Generally, the extending members 50 can be retracted inward to house materials placed thereon having a more narrow width, or can be pushed inward to a maximum retracted position for the stowing or transporting of the platform 38. Conversely, the frame members 50 can easily and smoothly be extended outward, to their fully extended positions for securing materials having a larger width, A spring clip 86 is mounted to a laterally displaceable mount 88, or other suitable adjusting means, on each slidable portion 60. Each mount 88 is substantially identical in structure and function and comprises a fixed groove 90 having a pair of upstanding channel flanges within which is fitted sliding element 92, as shown in FIG. 2. The sliding element 92 has a cross-sectional shape interlocking with the cross-sectional shape of the groove 90 within which it is slidably disposed. The grooves 90 are fastened to the slidable portions 60 of the panels 56 using rivets or the like, and have a lateral dimension about 0.25 to 1.0 inch less than that of the slidable portion 60 to which it is fastened. The length of grooves 90 is at least that of the spring clip 86, but not greater than that of the slidable portion 60. The releasable adjustment of the sliding elements 92 is obtained by spring loaded detents 54, similar to those described herein for the extending frame members 50.

The spring clips 86 may be of plastic, metal or other suitable material and are biased toward the mounts 88 at a pressure sufficient to restrain the open pages of the book placed thereunder, yet should be releasable with a minimum of effort by the user. The spring clips 86 are substantially identical in structure and function, but are mounted on opposite and opposing panels. The spring clips 86 are fastened to the outer edges of the sliding elements 92 and extend straight up and perpendicularly from the top surface thereof to loop over the open pages of a book and bear down on its pages. It is preferred that a plurality of non-slip, elastic buffers be attached to the portion of the clip 86 in contact with the book placed thereunder. The length of the spring clips 86 is preferably between approximately 2 inches to 8 inches, but not greater than the length of the sliding element 92 to which it is fastened. It is further desired that the dimension between the perpendicular risers of the spring clips 86 and their contact point with the book be between approximately 1 to 2 inches. The overall height of the clips 86 should extend perpendicularly to and raise away from the mount 88 to a height between approximately 1 to 2.5 inches The height of the spring clips 86 should accommodate books having a variety of thicknesses, including very thick books (i.e., 1000 pages or more).

As shown in FIGS. 1 and 3, a shelf 100 is formed or joined to the bottom of the central member 40 via a rest 96 and a connector skirt 98 and spans the width of the platform 38 when the frame members 50 are fully extended. The rest 96 supports the bottom edge of a book in alignment with the bottom of the platform 38 and should have sufficient strength and rigidity to support materials having a heavy weight. The connector skirt 98 is joined to the bottom of the central member 40 and the rest 96 extends forward, as best seen in FIG. 2. The shelf 100 is generally planar, but is tilted upward slightly to urge the book bottom toward the longitudinal section of the central member 44. The shelf 100 is preferably between about 1 to 2.5 inches wide at the center of the platform 38, but is wider at its ends, preferably by adding 1 to 2.5 inches to the distance between of the frame member 50 and the top surface of the sliding element 92 when the pivotable panels 56 are inclined to their maximum extent, The shelf 100, like the central member 40, is "V-shaped" or synclined, as best seen in FIG. 3. The angle formed by the outside edges of the shelf 100 is similar to that of the synclination angle $\alpha$ when the panels 56 are inclined to their maximum extent. At the outer edge of the shelf 100, the contour slopes upwardly between approximately a 30° to 45° angle to form the upper retaining ledge 102. The ledge 102 prevents the bottom of the book from sliding forward and off of the rest 96. The contour terminates with a horizontal lip 104. The shelf 100 has a plurality of attachment means 108 in the shelf lip 104 for a pair of optional arm supports 110, as discussed below. It is desirable that the attachment means be provided in the form of threaded female receptacles 108 as seen in FIG. 3, or other such attachment means.

Figure 4:
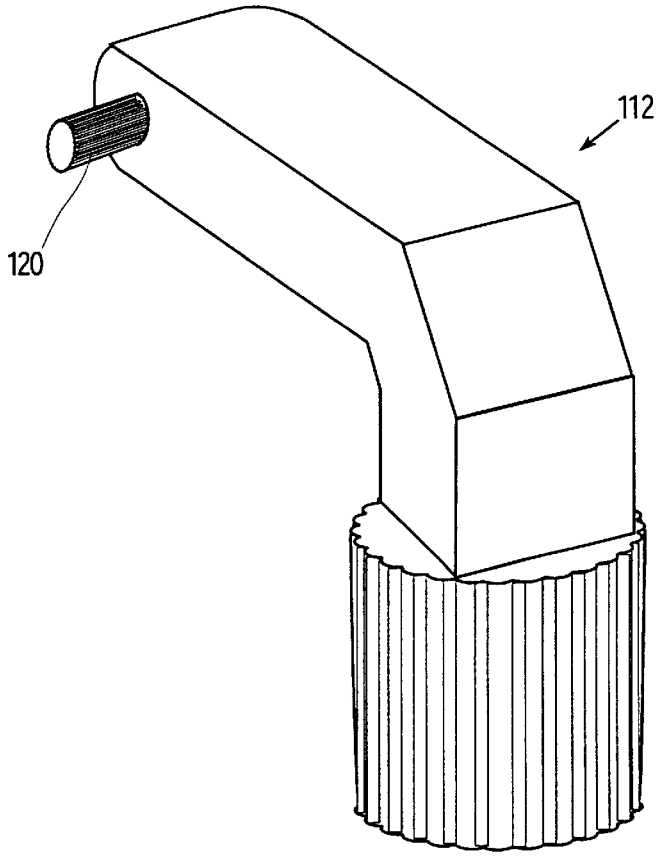
FIG. 4 is a perspective view of the multi-positional shoulder of the present disclosure.
Figure 5:
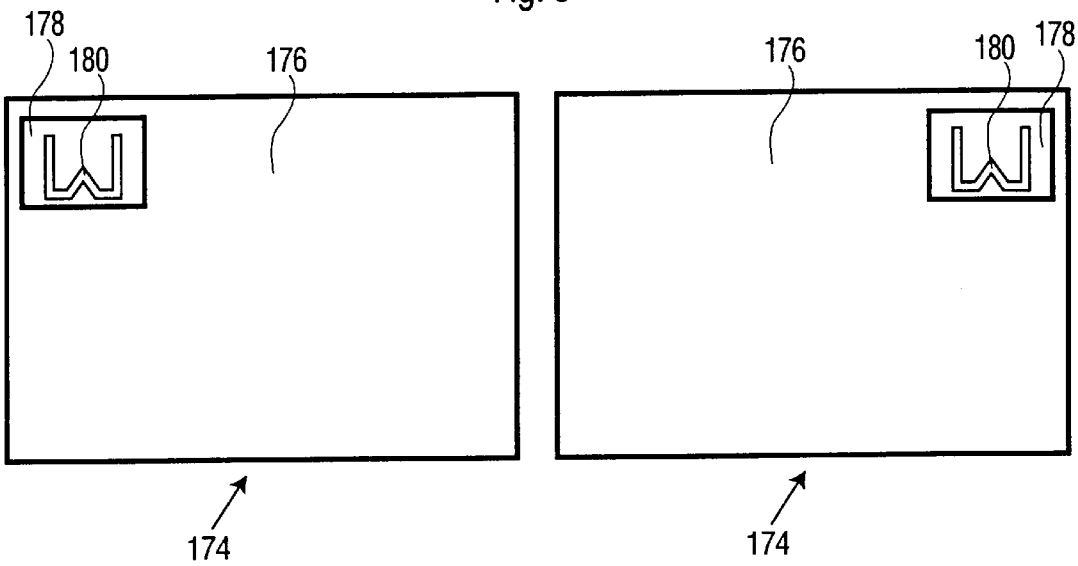
FIGS. 5(*a*) and 5(*b*) are elevational views of the left and right detachable newspaper holders, respectfully.

A multi-positional shoulder 112, as seen in FIGS. 1 and 2, is rotatably disposed within a vertical sleeve 114 projecting through the upper transverse portion 53 of each frame member 50 near the outside edge. The lower portion of each shoulder 112 is preferably cylindrical in shape and has interlocking splines meshing with the splines on the inner surface of the sleeves 114. The outside cross-sectional diameter of the lower portion of each shoulder 112 is slightly less than the inside cross-sectional dimension of the sleeve 114 into which it is disposed. The upper portion of each shoulder 112 preferably is of a square or rectangular cross-section and extends upwardly between approximately 1 to 3 inches from the top surface of the frame members 50, then bends rearwardly at an angle of approximately 30° to 45° for approximately 1 to 5 inches, as shown in FIG. 4. The sleeves 114 have a square outer cross-sectional shape and a cylindrical inner shape to match that of the lower portion of the shoulders 112, with a thickness sufficient to make it strong yet lightweight. The outside surfaces of the sleeves 114 extend from the frame members 50 so as to abut the longitudinal portion 51 of the frame members 50 in an adjacent and parallel manner. The sleeves 114 have an equal length of about 2 to 6 inches, with the upper terminating end of the sleeve 114 extending approximately 0.5 inch above the top surface of the frame members 50. Locking means for the multi-positional shoulders 112 are provided via shoulder lock screws 116 or other suitable releasable locking means, near the top of each sleeve 114. The shoulders 112 may conveniently be swiveled within 360° of rotational freedom as desired.

The platform 38 is conveniently supported at the desired angle and distance from a support surface via a pair of telescoping arms 118, which serve both as props and suspension means in numerous working positions. The telescoping arms 118 are rotatably coupled to the shoulders 112 via a splined post 120, or other suitable attachment means, projecting outwardly near the upper terminating end of each shoulder 112. The arms 118 are substantially identical in structure and function and preferably comprise an upper piece 122 and a lower piece 124. The splined posts 120 are cylindrical in shape and have an outside cross-sectional diameter slightly less than that of the inside cross-sectional diameter of a splined receptacle near the top end of each upper piece 122. Releasable locking means to lock the arms 118 into various positions on the splined posts 120 as desired are provided by a lock screw 116. It is preferred that both pieces 122, 124 be hollow, rectangular or square in cross-section and have a cross-sectional thickness designed to maximize strength, compactness and durability. It is preferable that the upper piece 122 have a length of about 100% to 150% of that of the longitudinal length of the frame member 50.

Attachment means are provided on the inside surface of each upper arm piece 122 near its midpoint, as further discussed below. It is preferable, however, that the attachment means be provided by a threaded orifice 196. The lower piece 124 is slidably disposed within upper piece 122. The lower piece 124 has a length greater than that of the upper piece 122 to ensure that several inches of the lower piece 124 extends from the upper piece 122 when the lower piece 124 is fully retracted. Locking means for the telescoping arms 118 are provided by spring loaded detents 54, similar to those that are described herein for the frame members 50. The detents 54 in the telescoping arms 118 permit the two pieces 122, 124 to be locked together at any of a plurality of extended lengths, allowing the arms 118 to be placed in almost any position to provide support for the platform 38. Adjustment of the telescoping arms 118 length allows adjustment of the distance of the platform 38 from the user, as well as adjustment of the angle of the platform relative the user's line of sight, both permitting the user to better focus on the book secured therein. Also, the number of telescoping arm 118 positions permits a number of adjustments to stabilize and support the platform 38 without the continuous use of its user's hands Because the shoulders 112 are advantageously disposed on the outward lateral edges of the platform 38, the arms 118 will not intersect or interrupt the reader's line of sight while viewing or reading the books centrally secured thereon. Additionally, the outward positioning of the arms 118 advantageously allows the platform 38 to accommodate or support oversized books placed thereon that may extend outwardly beyond the top edge and left and right lateral edges of the platform 38.

Figure 8:
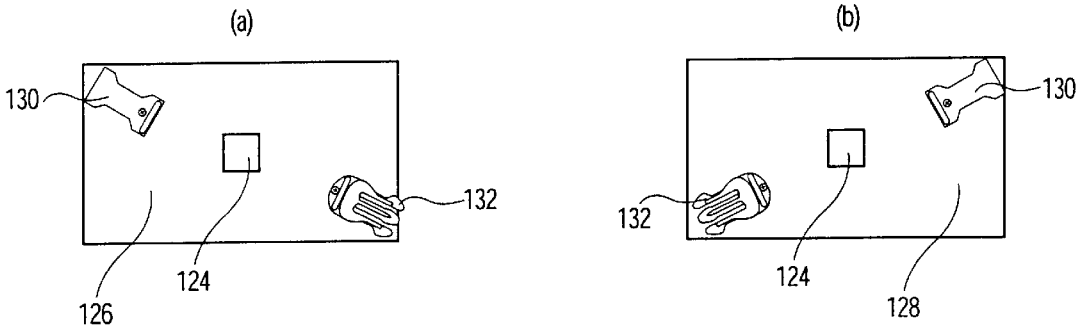
FIGS. 8(*a*) and 8(*b*) are elevational views of the left and right arm bases, respectfully, with a view of the strap clasps.
Figure 9:
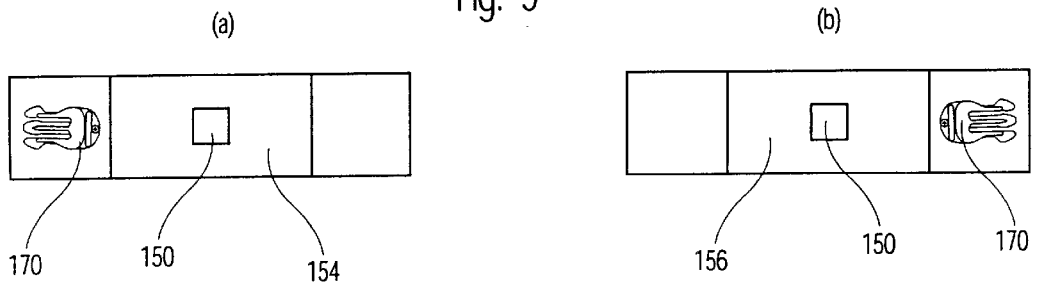
FIGS. 9(*a*) and 9(*b*) are elevational views of the left and right leg bases, respectfully, with a view of the strap clasps.

One of a pair of arm bases 126, 128, shown in detail in FIGS. 8(*a*) and 8(*b*), are joined at the terminating end of each lower arm piece 124. The arm bases 126, 128 are substantially identical in structure and function and are designed to maximize friction on a wide variety of surfaces, serving to stabilize the entire platform 38. The arm base 126, 128 generally are planar in shape and preferably are made of plastic with a thin membrane of non-slip material, such as rubber 158 or other such elastic and resilient material. attached to the bottom surface to provide increased friction and also to provide a pliant contact material to protect any surface upon which the arm bases 126, 128 may be placed.

The multi-positional shoulder 112 allows the user to swivel or rotate the shoulder 112 in an arc of 360° to pivot the coupled arm 118 and support the platform 38 in a wide array of positions, including inwardly toward the center of the central member 40 or outwardly away from the platform 38, and allows the user to adapt the platform 38 to the physical environment in which it is used. When not in use, the arms 118 can be swung or folded downward, parallel and adjacent to the longitudinal portions 51 of the frame members 50 for stowing or transporting the platform 38. Examples of some positioning benefits of the multi-positional shoulder 112 are shown in FIG. 2, where the arms 118 are shown attached to the attachment means 108 of lip 104.

As seen in FIGS. 8(*a*) and 8(*b*), a female buckle clasp 130 and a male buckle clasp 132 are attached to the top surface of each arm base 126, 128. The buckle clasps 130, 132 are preferably made of plastic or other such durable and resilient material and are similar to the Tifco™ clasps taught in U.S. Pat. Nos. 4,150,464 and 4,171,555 to Tracy. It is preferable that the clasps 130, 132 be connected to the arm base 128 using a short piece of flexible material such as nylon, dacron or the like that is pliable and resilient. With this short piece of material looped through a slot in the clasps 130, 132, one or more rivets attach the terminating ends of this material together and to the top surface of the base 126, 128. The short piece of material should have enough slack to allow the clasps 130, 132 to be lifted and positioned for buckling with its mating clasp 130, 132, but its length is short enough to ensure that movement of the clasps 130, 132 is directly transferred to the base 126, 128. The female clasps 130 are set in the opposite direction to that of the male clasps 132 to face outwardly and downwardly at approximately a 45° angle to the horizontal axis when the bases 126, 128 are placed against the user's chest. The male clasps 132 are attached to the inside half of the top surface of each base 126, 128 and face inward, toward the center of the platform 38, and upward at approximately a 45° angle to the horizontal axis. The positioning of the clasps 130, 132 on the base 126, 128 is designed to provide optimal securement of the platform 38 against a user's torso using a pair of connector straps 162, 164, described below.

Figure 10:
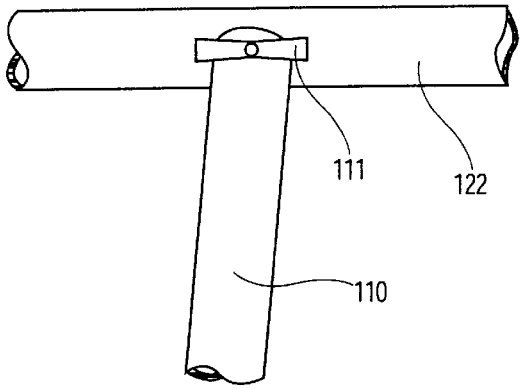
FIG. 10 is a partial elevation view of a supplemental support leg of the present disclosure.
Figure 11:
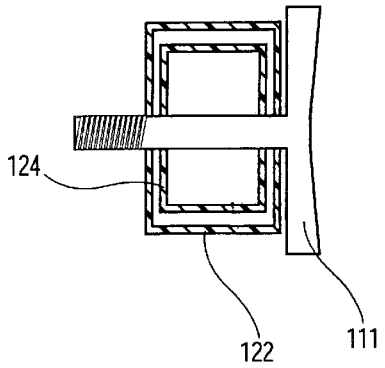
FIG. 11 is a cross-sectional view of a supplemental support leg of the present disclosure.

A pair of optional arm supports 110 are provided to provide additional stability and increase the sturdiness and rigidity of the platform 38, particularly when the axis of the arms 118 form approximately a 90° angle relative the axis of the longitudinal section 44 of the central member 40 and the arms 118 are positioned in front of the platform 38, as shown in FIG. 2. The preferably plastic arm supports 110 are substantially identical in their structure and function and comprise a telescoping member with attachment means at each end. It is desirable that the lower terminating end of each support 110 have cooperating attachment means, such as a threaded stud for removably threading the support 110 into any of the attachment means 108 in the shelf rest 96. It is further preferred that the supports 110 have a threaded wing nut-type bolt 111, best seen in FIGS. 10 and 11, extending perpendicularly through the support 110 near the end opposite the threaded stud to removably attach the upper end of the support 110 to the threaded orifice 196 of arm 118.

The platform 38 can also be supported at a desired height above a support surface by a pair of retractable multi-positional legs 134. The legs 134 extend downward from the interior of the hollow longitudinal portion 51 of each frame member 50 and preferably comprise three segments with pivotable connecting means therebetween. The legs 134 are substantially identical in structure and function, are independently adjustable and rotate 360° within the longitudinal portion 51 of the frame member 50. The legs 134 are articulated to allow adjustment of the legs 134 to support the platform 38 in an array of positions. The legs 134 also provide an adjusting means for setting the vertical orientation of the book so that the center of the book is substantially perpendicular to the reader's line of sight, relieving neck strain typically associated with reading.

As best shown in FIG. 2, a first leg segment 140 of the leg 134 is rotatably (within 360° of rotation), retractably and longitudinally mounted within the interior of the hollow longitudinal portion 51 of each frame member 50. It is preferred that the top portion 141 of the first leg segment 140 be cylindrical, allowing rotation of the segment 140, and the entire leg 134, relative the longitudinal portion 51 of the frame member 50. The upper, cylindrical portion 141 of the segments 140 is hollow and provided with a series of vertically arranged holes distributed in a regular pattern over a substantial portion of its surface, providing a number of positions wherein a pair of clevis pins 142, or other suitable releasable locking means, can pass through any of a pair of such holes in the upper portion of the first segment 140, A plurality of pairs of clevis holes 144 are disposed on the longitudinal portion 53 of each frame member 50 to facilitate the locking of the first segment 140, along with the rest of the attached leg 134, into any of numerous positions of sliding retraction, as shown FIG. 1. The ends of the pins 142 are inserted through a pair of clevis holes 144 in the longitudinal portion 53 and selectively register with any pair of holes in the upper section of the first leg segment 140. Additionally, for each position of retraction, determined by the pair of clevis holes 144 chosen, there are a number of positions of rotation of the first leg segment 140 for the entire leg 134. Thus, a releasable attachment within the hollow longitudinal portion 53 of the extending frame members 50 is provided.

The legs 134 may be independently retracted or extended as needed. While the lower portion 143 of each first leg segment 140 can have a variety of cross-sectional shapes, such as circular or triangular, it is preferred that a square or rectangular cross-section is adopted, with a cross-sectional dimension slightly smaller than the inside cross-sectional diameter of the longitudinal portion 53 of the frame member 50 into which it is slidably disposed. A second leg segment 146 has a cross-section dimension equal to that of the lower portion 143 of the first leg segment 140, and is coupled to the lower portion 143 of the first leg segment 140 via a first joint 148 that is preferably releasably lockable and adjustable via interlocking splines by screw means. The first joint 148 is pivotable in the plane of the axis of the first leg segment 140 and the second leg segment 146. A third leg segment 150 has a cross-section dimension equal to that of the second leg segment 146 and is coupled to the bottom of the second leg segment 146 via a second joint 152, which is also preferably releasably lockable and adjustable via interlocking splines by screw means. The second joint 152 is similarly pivotable in the plane of the axis of the second leg segment 146 and the third leg segment 150. The aggregate length of all three segments 140, 146, 150, when coupled together via the joints 148, 152, is greater than the length of the longitudinal portion 51 of the frame member 50 into which they are disposed, ensuring that the third leg segment 150 extends beyond the frame members 50 when the legs 134 are fully retracted, as shown in FIG. 1.

One of a pair of foot bases 154, 156 is joined to each third leg segment 150. The foot bases 154, 156 are substantially identical in structure and function and are of sufficient size and shape to maximize friction upon a wide variety of surfaces, serving to stabilize the entire platform 38. It is desirable, however, that the mid-portion of the bases 154, 156 be concave or semi-circular in shape, with planar ends. The bases 154, 156 are preferably molded from durable, rigid plastic and preferably have a thin membrane of non-slip material, such as rubber 158, attached to their bottom surface to provide increased friction and a pliant contact material to protect any surface the bases 154, 156 are placed upon, whether, that is, the legs of the user or an article of furniture occupied by its user. The contour shape provides a support base that will rest well upon a variety of surfaces having different shapes, angles and textures, in contrast to the support bases of the prior art designed for use on a flat surface only. Here, however, the contour of the instant invention provides maximum frictional contact against, among other things, the legs of the user.

This semi-circular shape enables the bases 154, 156 to be placed comfortably over its user's legs in either a seated and semi-seated posture. The contour adds more surface area in contact with the user's legs than a flat base. On the other hand, the planar ends of the bases 154, 156 provide a frictional planar surface to allow its user to place them onto flat or semi-flat surfaces as well.

A male foot clasp 170, identical to the male arm clasps 132 described above, is attached to the top surface of each base 136, 138 and faces outward, away from the third segment 150. It is preferable that the clasps 170 be connected to the base 136., 138 in the same manner as the arm clasps 130, 132 described above.

A connector strap such as strap 160 can be used to adjustably span the distance between the arms 118, with the straps' ends removably fastened to the male clasps 132 attached to the upper side of the hands 126, 128. The strap 160 has a female clasp 161 at each end and is made of a flexible material such as that described herein which connects the clasps to the arm bases 126, 128. The connector strap 160 is optional, and therefore is used when desired by its user in certain modes of operation.

For example, in one mode of operation, with the user sitting upright, the strap 160 can be used to stabilize and provide lateral support for the upper portion of the platform 38 when the platform 38 placed in the user's lap. In this mode of operation, the center of the connector strap 160 is placed behind the user's head and against the back of the user's neck. The strap 160 is preferably placed behind the user's head by placing one of the arms 118 over one of the user's shoulders, and the other arm 118 over its user's other shoulder. Given that in the preferred embodiment the vertical plane of the platform 38 is inclined slightly away from the user in this mode of operation, the weight of the platform 38 will exert a gravitational force on the top portion of the platform 38, pulling the platform 38 and its connected arms 118 forward away from its user. The platform 38 will be restrained as the strap 160 biased against the user's neck, which in turn will stabilize and support the platform 38 in its upright position without the user's hands holding it.

Figure 12:
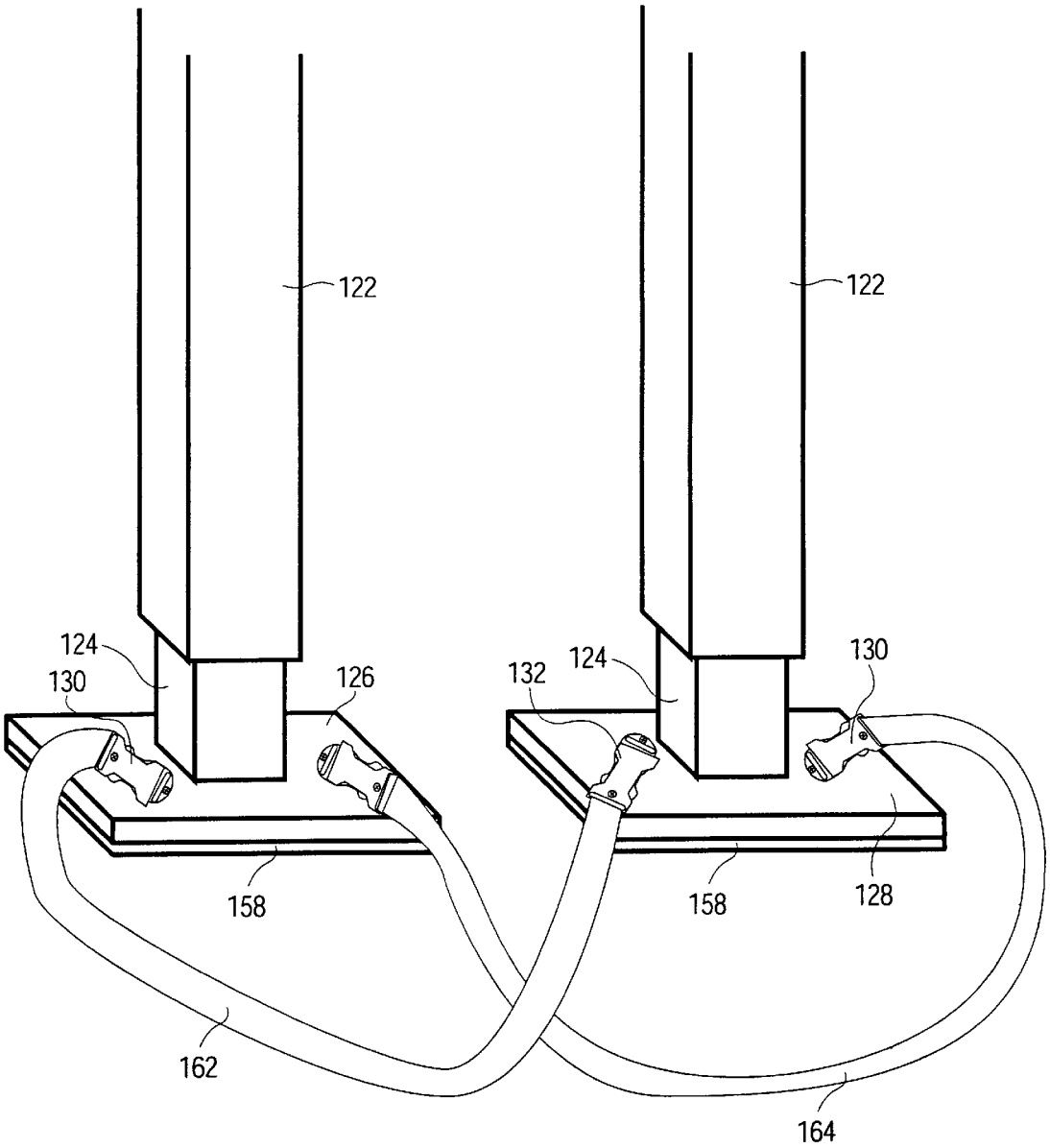
FIG. 12 is a perspective view of the left and right arm bases, respectfully, with a view of the strapping system of the present invention.
Figure 13:
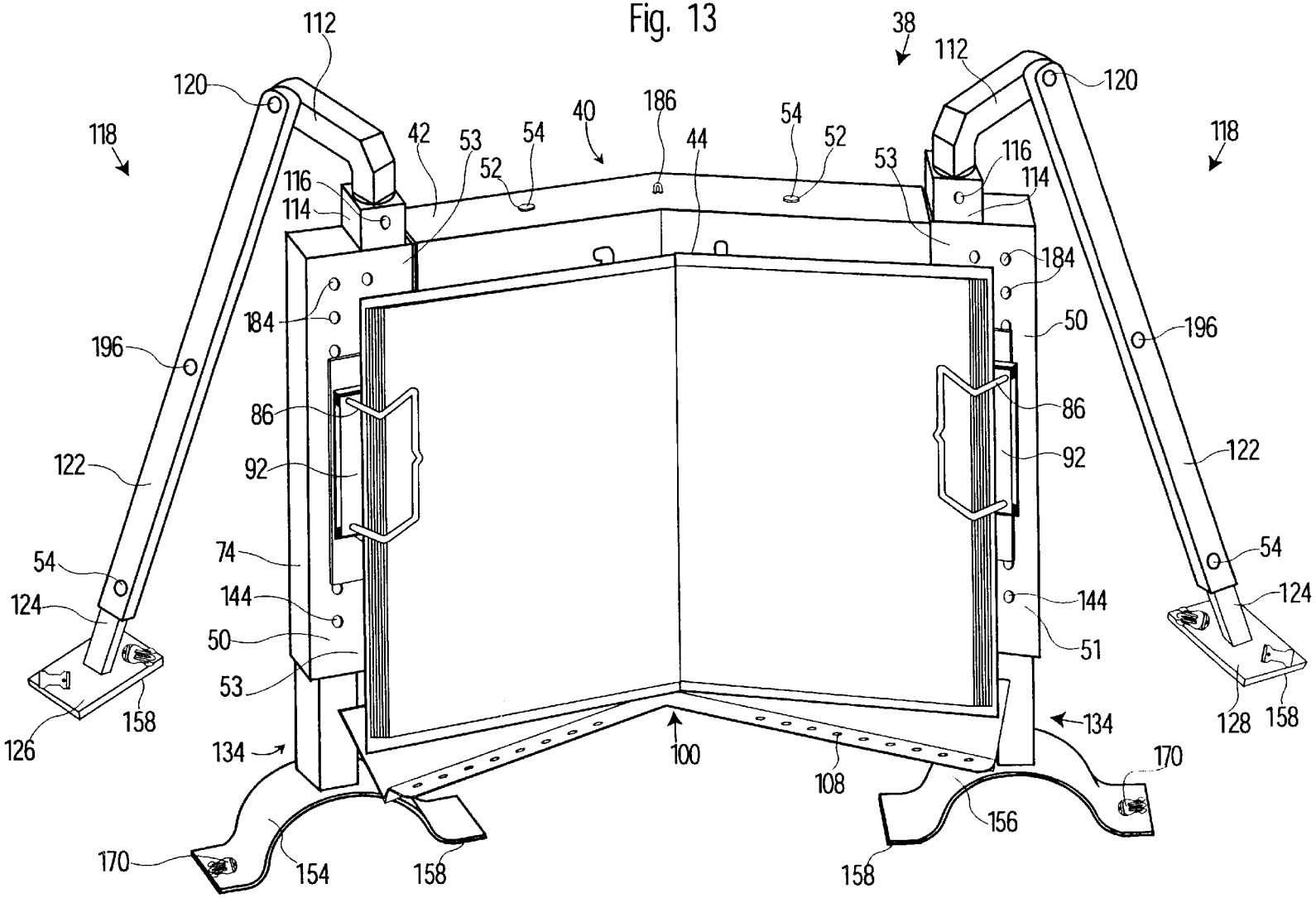
FIG. 13 is a perspective view of a first embodiment of the adjustable, portable platform of the present disclosure, showing the written materials being held in position.

Two connecting straps 162, 1649 identical in structure and function, can be used in certain modes of operation to releasably secure the arm base 126, 128 of the platform 38 to the user's upper torso. Each strap 162, 164 terminates with a female clasp at one end and a male clasp at the other end and is made of material similar to that as connector strap 160. Preferably, the length of the straps 162, 164 are adjustable. As is more fully described below and as shown in FIG. 12, the straps 162, 164 are buckled to the arm bases 126, 128 and crossed behind the user's upper back or shoulder area when the arm bases 126, 128 are placed against the user's chest. When the shoulder straps 162, 164 are used in conjunction with an optional leg strap 168, similar in structure and function to strap 160, the platform 38 is effectively secured to the user's torso in such a way as not to interfere with the use of the platform 38, thereby affording the user ease of movement and comfort while leaving the user's hands free for other chores. Further, the secured platform 38 allows the user to stand, move about, walk, run or lay down with the platform 38 maintaining the desired vertical and horizontal orientation of the book substantially perpendicular to the user's line of sight. This allows the user to better focus on the book secured therein, and relieves unnecessary neck strain.

The leg strap 168 mentioned previously is likewise adjustable to span the distance between the legs 134 and its ends are removably buckled to the male clasps 170 attached to the base 154, 156. The leg strap 168 is optional and is therefore used only in certain modes of operation as noted above. For example, in one mode of operation, with the user running on a treadmill, the leg strap 168 can be used to secure the legs 134 of the platform 38 to the user's torso. In this mode, the bottom surface of the base 136, 138 are placed against the user's abdomen near the navel. One end of the strap 168 is buckled to the male clasp 170 of a base 154, with the leg strap 168 passed behind and around the waist of the user and the other end buckled with the male clasp 170 of the other foot 156.

Figure 6:
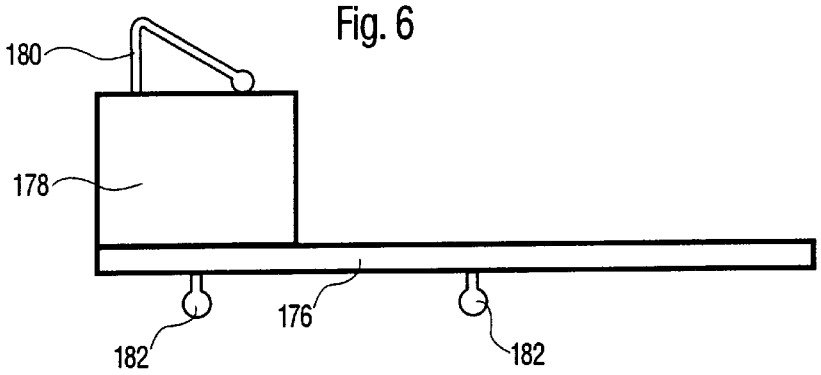
FIG. 6 is a side view of the left detachable newspaper holder shown in FIG. 5(*a*)

Optionally, a pair of detachable newspaper holders 174 conveniently allow the user to releasably secure newspapers, maps and other oversized materials to the platform 38. The newspaper holders 174 are substantially identical in structure and function and are used in certain modes of operation. The newspaper holders 174 are removably secured by any suitable means to the outside, upper corner of each frame member 50. The newspaper holders 174 preferably comprise a planar foundation 176, a pedestal 178, a newspaper spring clip 180 and attachment pegs 182 (best shown in FIG. 6). The foundation 176 is preferably square or rectangular in shape with a thickness to maximize strength and durability, yet is lightweight. It is desirable that the foundation 176 be between about 3 to 5 inches square and have approximately three attachment pegs 182 extending perpendicularly therefrom. Each attachment peg 182 is identical, each being generally cylindrical in shape with an enlarged, rounded head that snaps into a matching peg hole 184 in the frame member 50. The pegs 182 are preferably between about 0.25 and 0.50 inch in diameter. The pedestals 178 generally are cubical in shape and are attached to the upper and outer corners of each foundation 176. The size of each pedestal 178 is preferably equal to the distance from the top surface of the slidable portion 60 to the point on the pageholder spring clips 86 furthest away from the platform to provide the height necessary to allow the pages of the newspapers, or other oversize materials, to hang unimpeded and uninterrupted beyond the height of the page holder spring clips 86 when they are secured to the top surface of the pedestal 178. The newspaper spring clips 180 are attached to the top surface of the pedestal 178 and are similar in design and function to the previously described page holder spring clips 86, except they are smaller. The newspaper clips 180 face downward, toward the shelf rest 96, and preferably have a length between approximately 1 to 2 inches with a width between approximately 1 to 2 inches. The clips 180 raise perpendicularly about between 0.33 to 0.75 inch above the top surface of the pedestals 178 to releasably secure a substantial number of newspaper pages or other materials.

Figure 7:
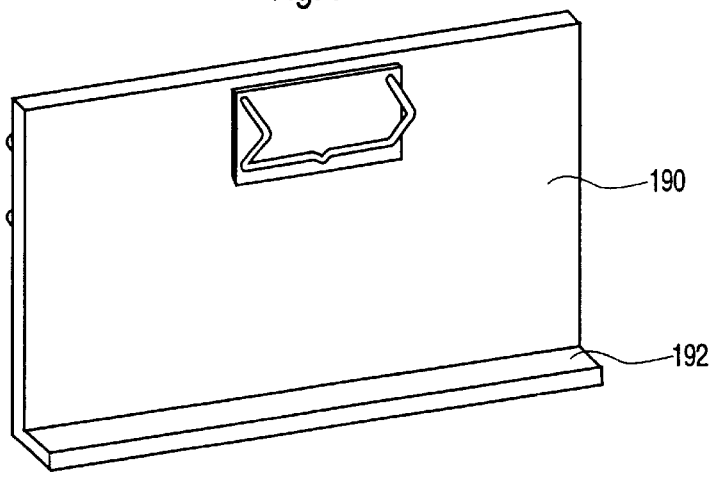
FIG. 7 is a perspective view of a writing surface attachment for use with the present invention.

It will be appreciated that the platform 38 may also be employed as a writing desk. Thus, a writing surface attachment 190 (FIG. 7) can be provided that should generally be planar, square or rectangular in shape and removably secured by any suitable means to the platform 38. The means for securing the writing surface attachment 190 to the platform 38 can be provided by four attachment pegs 182, identical to those described for the newspaper holder platform 174 that extend perpendicularly from the bottom surface of an identical pedestal 178 attached to the underside of said writing surface 190, near each corner. The height of this pedestal 178 is such that the bottom surface of the writing surface attachment just clears the page holder spring clips 86 when the page holder platforms 56 are flattened to their stowed positions. A document ledge 192 projects the width of the writing surface attachment 190 and is joined to the top surface near its bottom edge to prevent the downslipping of materials placed thereon. Additionally, a clipboard style clip may be fastened to face downward near the upper edge of said attachment 190 near its center to assist in holding materials placed thereon.

Preferably, as seen in FIG. 1, a pair of spine strap eyelets 186 are provided to removably attach a book spine strap extending therebetween for modes of operation wherein books, when placed on the platform 38, have a tendency, from gravity or motion, to separate from the platform 38. One spine strap eyelet 186 is attached to the center of the upper transverse section 42 and the other spine eyelet 186 is attached to the center of the lower transverse section 42 of the central member 40. The book spine strap is adjustable, such as the strap 168, or made from an elastomeric material. The spine strap preferably has a "J-style" hook on each end that is removably engaged with the eyelets 186. With the ends of the spine strap connected to the eyelets 186, the strap is drawn tight through the crease, or junction of the open pages of the book. This, in turn, secures the center of the book to the longitudinal section 44 of the central member 40 and to the entire platform 38. The strap is most advantageously used for certain modes of operation, such as for a supine reader or for a jogger, In operation of the instant invention, aside from that apparent from the above description, the platform 38 can be used in various ways. When needed to use the platform 38 on a planar, or semi-planar, surface, like an easel, the arms 118 are swung toward the back of the platform 38 and locked to support the platform 38 in an upright, but rearwardly inclined, position. The rearward inclination can be adjusted via the telescoping arms 118 to suit the surface rested upon, whether a table top, couch or bed. The frame members 50 can be adjusted to a width slightly larger than that of the opened book, or other materials, placed thereon. The page holder spring clips 86 are adjusted to accommodate the opened pages of the book, by moving and locking the sliding mount 88 to the appropriate width. Optimal placement of the spring clips 86 entails adjusting the mounts 88 to a position where the ends of the clips rest on the outer margins of the book pages, such that the clips 86 do not obstruct the text. The spine of the book bears rearwardly against the longitudinal section 44 of the central member 40. The book is thus confined in the position so secured and lateral movement of the book is prevented during the turning of the pages.

Conversely, the arms 118 and legs 134 can be extended perpendicularly relative the longitudinal section 44 of the central member 40 and locked to support the platform 38 above the user's head when in the supine position or behind the neck of its user with strap 162. In the case of use in the supine position, no straps are needed. Additionally, the user may secure the platform 38 to their torso for standing, exercising or moving about using the optional straps 162, 164 about the shoulders and strap 168 behind the legs or waist.

In this case, the female clasp of the connector strap 162 is locked with the male clasp 132 attached to the arm base 126. With the arm base 126 of the platform 38 against the user's upper chest, near the shoulder, the connector strap 162 is draped underneath its user's armpit, behind and across its user's back and over the other shoulder where the terminating male clasp of strap 162 is buckled to the female clasp 130 attached to the other arm base 128. The other arm base 128 of the platform 38, in this mode of operation, is also placed against the user's upper chest near the other shoulder. With the first connector strap 162 so anchored and drawn snug, using the strap length adjuster, the other connector strap 164 is similarly connected. Thus, with the arm base 128 of the platform 38 still against the user's chest as previously described, the female clasp of the second connector strap 164 is buckled to the male clasp 132 attached to the arm base 128. The second connector strap 164 is thus draped downward underneath its user's other armpit, then behind and across the user's back and over his or her first shoulder, where the terminating male clasp is buckled to the female clasp 130 attached to the arm base 126.

To use the newspaper holder 174 so that the materials secured thereon do not interfere with the page holder spring clips 86, the base portions 58 should be pivoted to the position where the slidable portions 60 of the pivotable panel 56 are in contact with the top surface of the frame members 50.

The advantages of the writing surface platform are attained in an economical, practical and facile manner. To wit, an effective new platform for supporting printed or viewed materials while its user is in any number of imaginable postures has been developed.

While embodiments of the platform have been herein illustrated and described, it is to be appreciated that various changes, rearrangements and modifications may be made therein, without departing from the scope of the invention as defined by the appended claims.

What is claimed:

1. An adjustable, portable platform for supporting and holding written materials or the like in a selectable position convenient to a user, the platform comprising:

a central member having an upper transverse section and a lower transverse section joined at their respective centers by a longitudinal section;

a pair of laterally movable frame members, one frame member disposed on each side of the central member and engaging both the upper and lower transverse sections of the central member for lateral motion relative therebetween;

a pair of panels pivotally attached at a proximal end thereof to the platform proximate the central member substantially between the upper and lower transverse sections, each of the panels having retaining means thereon for securely retaining the written materials or the like in a secure position on the panels; and attachment means located on a distal end of each of the pivotable panels for attachment of the pivotable panels to one of the movable frame members such that the relative angle formed between the pivotable panels can be adjusted to accept the written materials or the like.

2. The adjustable, portable platform of claim 1, wherein the central member has a syncline shape such that the pair of frame members are not co-planar and are not in alignment with a single vertical plane, the longitudinal section of the central member imparting a syncline or "V-shape" configuration to the transverse sections.

3. The adjustable, portable platform of claim 1, wherein the movable frame members generally have a "U-shaped" configuration.

4. The adjustable, portable platform of claim 3, wherein each of the pair of movable frame members has an inside surface and the attachment means comprises a slotted flange extending from the pivotable panel in cooperation with a boss extending from the inside surface of the frame member for attaching the pivotable panel to the frame member.

5. The adjustable, portable platform of claim 1, wherein the moveable frame members are in selectively locking engagement with the central member.

6. The adjustable, portable platform of claim 1, wherein the retaining means is a book clip.

7. The adjustable, portable platform of claim 1 further comprising a shelf rest joined to the bottom of the central frame member and projecting transversely to span the width of the platform when the extending frame members are fully extended for support thereupon written materials and the like.

8. The adjustable, portable platform of claim 1, wherein the pivotable panels further comprise a base portion and a slidable portion attached to the base portion in lateral slidable relation, the proximal end of the base portion of the pivotable panels circumferentially engaging a vertical pin attached at an upper and lower end to the central member and the distal end of the slidable portion of the pivotable base portion having the attachment means for attaching the pivotable panel to the frame member.

9. The adjustable, portable platform of claim 8, wherein the attachment means comprises a slotted flange perpendicularly extending from the pivotable panel for engaging a boss extending from an inside surface of the frame member for attaching the pivotable panel to the frame member.

10. The adjustable, portable platform of claim 1, wherein a pair of adjustable upper arms are pivotably attached to an upper portion of each of the laterally movable frame members, the upper arms comprising a shoulder, an upper piece, a lower piece longitudinally and slidably received within the upper piece and a base for supporting the platform.

11. The adjustable, portable platform of claim 1, wherein a pair of adjustable lower legs are pivotably attached to a lower portion of each of the laterally movable frame members, the lower legs comprising an upper section and a lower section articulately attached relative the upper section and a base attached to the lower section for supporting the platform.

12. The adjustable, portable platform of claim 1, wherein a pair of adjustable upper arms and a pair of adjustable lower legs are pivotably attached to each of the laterally movable frame members, the upper arms comprising a shoulder, an upper piece, a lower piece longitudinally and slidably received within the upper piece and a base for supporting the platform and the lower legs comprising an upper section and a lower section articulately attached relative the upper section and a base attached to the lower section for supporting the platform, each of the leg and arm bases having clasps on an upper surface thereof for attachment to a connecting strap.

13. An adjustable, portable platform for supporting and holding written materials or the like in a selectable position convenient to a user, the platform comprising:

a central member having an upper transverse section and a lower transverse section joined at their respective centers by a longitudinal section;

a pair of laterally movable frame members, one frame member disposed on each side of the central member and engaging both the upper and lower transverse sections of the central member for slidable motion relative therebetween;

a pair of pivotable panels pivotally attached to the platform proximate the central member substantially between the upper and lower transverse sections, each of the pivotable panels further comprising a base portion and a slidable portion attached to the base portion in lateral slidable relation, a proximal end of the base portion of each of the pivotable panels circumferentially engaging a vertical pin attached at an upper and lower end to the central member and each of the panels having book clips thereon for securely retaining the written materials or the like in a secure position on the panels; and attachment means located on a distal end of each of the slidable portions of the pivotable panels for attachment of the pivotable panels to one of the movable frame members such that the relative angle formed between the pivotable panels can be adjusted to accept and adapt to the written materials, the attachment means comprising a slotted flange perpendicularly extending from the pivotable panel for engaging a boss extending from an inside surface of the frame member for attaching the pivotable panel to the frame member.

14. The adjustable, portable platform of claim 13 further comprising a writing surface attachment having a planar and rectangular shape removably secured to the platform and a document ledge projecting the width of the writing surface attachment.

15. The adjustable, portable platform of claim 14, wherein the writing surface attachment has a clipboard style clip oriented to face downward near an edge of the writing surface attachment near its center to assist in holding materials placed thereon.

16. The adjustable, portable platform of claim 13 further comprising a pair of newspaper supports secured to each of the laterally movable frame members at an upper outer corner of each frame member, the newspaper supports each having a clip for mounting written materials or the like thereupon.

17. The adjustable, portable platform of claim 13, wherein the base portion has a plurality of transverse slots and the slidable portion has a plurality of studs slidably engaging the transverse slots for transverse motion of the slidable portion relative the base portion.

18. The adjustable, portable platform of claim 17, wherein the slidable portion further comprises a laterally displaceable mount including a groove having a pair of upstanding channel flanges within which is situated a sliding element upon which the book clips are affixed, the sliding element having an interlocking cross-sectional relation to the channel flanges for lateral motion of the sliding element relative the slidable portion.

19. An adjustable, portable platform for supporting and holding written materials or the like in a selectable position convenient to the user, the platform comprising:

a longitudinally synclined central member having an upper transverse section and a lower transverse section joined at their respective centers by a longitudinal section;

a pair of laterally movable frame members, one frame member disposed on each side of the central member and engaging both the upper and lower transverse sections of the central member for slidable motion relative therebetween;

a pair of panels pivotally attached at a proximal end thereof to the platform in synclined relation one to the other proximate the central member substantially between the upper and lower transverse sections, each of the panels having book clips thereon for securely retaining the written materials or the like in a secure position on the panels;

attachment means located on a distal end of each of the pivotable panels for attachment of the pivotable panels to one of the movable frame members such that the relative angle formed between the pivotable panels can be adjusted to accept and adapt to the written materials;

a pair of multi-positional shoulders rotatably disposed within a vertical sleeve projecting through the top of each extending frame member near its outside edge, a telescoping arm rotatably coupled near a top of each shoulder and a base joined to a bottom of each arm; and a pair of retractable, multi-positional legs extending downwardly from a hollow longitudinal portion of each extending frame member comprising multi-positional segments jointed to allow adjustable placement of the legs to support the platform in a number of positions and a base joined to a bottom of the each leg.

20. The adjustable, portable platform of claim 19, wherein the leg base generally has a concave shape with planar ends.

21. The adjustable, portable platform of claim 19, wherein an arm connector strap adjustably spans the distance between the arms, the arm connector strap being adapted for placement behind a user's head and against the back side of a neck when the user is in a seated posture.

22. The adjustable, portable platform of claim 19, wherein the arms are extended perpendicularly relative the longitudinal section of the central member and each of the arm bases further comprises a pair of connector strap clasps, a first of the clasps of a right arm base engaging a first end of a first connector strap, the first connector strap being draped underneath a user's right armpit, behind and across its user's back and over the left shoulder, its second end engaging a first of a pair of connector strap clasps on a left arm base, a second of the clasps of the left arm base engaging a first end of a second connector strap, the second connector strap being draped downward underneath the user's left armpit, then behind and across the user's back and over a right shoulder, and a second end of the second connector strap engaging a second of the pair of clasps on the right arm base.

23. The adjustable, portable platform of claim 19, wherein a leg connector strap adjustably spans the distance between the legs, the leg connector strap being adapted for placement behind a user's legs or waist when the user is in a seated or standing posture.

24. The adjustable, portable platform of claim 19, further comprising a shelf rest joined to the bottom of the central member projected transversely and equally from the central member to support the written materials or the like.

25. The adjustable, portable platform of claim 19, wherein each of the arms is supported by an arm support attached at an upper terminating end of an arm support to a midpoint of the arm, a lower terminating end of the arm support being attached to the platform.

* * * * *

UNITED STATES PATENT AND TRADEMARK OFFICE

CERTIFICATE OF CORRECTION

PATENT NO. : 6,015,129

DATED : January 18, 2000

INVENTOR(S) : Christopher L. Harrigan

It is certified that error appears in the above-identified patent and that said Letters Patent is hereby corrected as shown below:

In the Abstract, on line 9 of the abstract, the word "means should be --devices--; and on line 19 o f the abstract, the word "means" should be removed.

In column 11, line 18, the reference number "44" should be, --40--, and after the word "section" the reference number, --44 --, should be inserted.

In column 11, line 39, the word "vertical" should be, --shoulder--.

In column 13, line 18, after the name "Tracy" the phrase,--Bakker et al., respectively --, should be inserted.

In column 14, lines 22,27,33, and 41, the reference number "53" should be,--51--.

In column 16, line 21, the reference number "136, 138" should be,--154, 156 --.

In column 18, claim 1, on lines 40, 54, 55 and 61, the phrase "or the like" should be removed.

In column 18, claim 2, line 66, the phrase "or'V-shape"' should be removed.

In column 19, claim 3, line 2, after the word "members" the word,--each--, should be added.

In column 19, claim 7, line 15, the phrase "the bottom" . should be replaced by the phrase, --the lower transverse section--, and on line 16 of the claim, after the word "central", the word, --frame--, should be removed, and on line 18 and 19 of the claim, the phrase "and the like" should be removed.

In column 19, claim 8, line 21, after the words "panels" the word, --each --, should be inserted.

UNITED STATES PATENT AND TRADEMARK OFFICE

CERTIFICATE OF CORRECTION

PATENT NO. : 6,015,129

DATED : January 18, 2000

INVENTOR(S) : Christopher L. Harrigan

It is certified that error appears in the above-identified patent and that said Letters Patent is hereby corrected as shown below:

In column 19, claim 9, line 29, after the word "wherein", the phrase, -- each of --, should be inserted.

In column 19, claim 13, line 61, the phrase "or the like" should be removed.

In column 20, claim 13, line 14, the phrase "or the like" should be removed.

In column 20, claim 15, line 31, the phrase "clipboard style" should be removed.

In column 20, claim 16, line 39, the phrase " or the like" should be removed.

UNITED STATES PATENT AND TRADEMARK OFFICE

CERTIFICATE OF CORRECTION

PATENT NO. : 6,015,129

DATED : January 18, 2000

INVENTOR(S) : Christopher L. Harrigan

It is certified that error appears in the above-identified patent and that said Letters Patent is hereby corrected as shown below:

In column 20, claim 17, line 41, after the word "wherein", the phrase, --each of--, should be inserted, and on line 42 of the claim, at the end of the word "portion", an, --s--, should be added.

In column 20, claim 18, line 46, after the word "wherein", the phrase, --each of--, should be added, and further on line 47 and line 53 of the claim, at the end of the word "portion", an, --s--, should be added, and, at the end of the word "comprises", the , --s--, should be removed In column 20, claim 19, line 55, the phrase "or the like" should be removed.

In column 21, claim 19, line 4, the phrase "or the like" should be removed.

In column 22, claim 22, on lines 4 and 10, the word "being" should be replaced by, --adapted to be--.

UNITED STATES PATENT AND TRADEMARK OFFICE

CERTIFICATE OF CORRECTION

PATENT NO. : 6,015,129

DATED : January 18, 2000

INVENTOR(S) : Christopher L. Harrigan

It is certified that error appears in the above-identified patent and that said Letters Patent is hereby corrected as shown below:

In column 22, claim 24, line 21, the phrase "the bottom" should be replaced by the phrase, --the lower transverse section--, and on line 22 of the claim, the phrase "and equally" should be removed, and on line 23 of the claim, the phrase "or the like" should be removed.

Signed and Sealed this

Nineteenth Day of December, 2000

*Attest:*

*Attesting Officer*

Q. TODD DICKINSON

*Commissioner of Patents and Trademarks*